US008109582B2

(12) United States Patent
Dubach

(10) Patent No.: US 8,109,582 B2
(45) Date of Patent: Feb. 7, 2012

(54) LOCKABLE PUSHING-OUT DEVICE

(75) Inventor: Fredi Dubach, Bäretwil (CH)

(73) Assignee: Julius Blum GmbH, Höchst (AT)

( * ) Notice: Subject to any disclaimer, the term of this patent is extended or adjusted under 35 U.S.C. 154(b) by 318 days.

(21) Appl. No.: 12/073,433

(22) Filed: Mar. 5, 2008

(65) Prior Publication Data

US 2008/0191592 A1 Aug. 14, 2008

Related U.S. Application Data

(63) Continuation of application No. PCT/AT2006/000347, filed on Aug. 23, 2006.

(30) Foreign Application Priority Data

Sep. 6, 2005 (AT) ..... A 1453/2005

(51) Int. Cl.
*A47B 95/02* (2006.01)

(52) U.S. Cl. ..... 312/319.1; 312/333

(58) Field of Classification Search ..... 312/333, 312/319.1, 334.44, 334.7, 334.8, 334.6, 384.21
See application file for complete search history.

(56) References Cited

U.S. PATENT DOCUMENTS

| | | | | |
|---|---|---|---|---|
| 3,516,369 | A * | 6/1970 | Bidak et al. | 108/138 |
| 3,854,784 | A * | 12/1974 | Hunt et al. | 312/9.63 |
| 4,828,344 | A | 5/1989 | Omata | |
| 5,040,833 | A | 8/1991 | Brunnert | |
| 5,143,432 | A | 9/1992 | Ohshima et al. | |
| 2004/0000850 | A1 * | 1/2004 | Lam Harn et al. | 312/333 |

FOREIGN PATENT DOCUMENTS

| | | | |
|---|---|---|---|
| DE | 911 925 | | 5/1954 |
| DE | 90 04 923 | | 8/1990 |
| DE | 295 07 917 | | 9/1995 |
| DE | 197 53 319 | | 7/1998 |
| DE | 201 00 804 | | 4/2001 |
| DE | 101 62 573 | | 7/2003 |
| DE | 20 2004 019 738 | | 4/2005 |
| DE | 20 2005 002 433 | | 6/2005 |
| DE | 202005002433 | * | 6/2005 |
| EP | 0 766 939 | | 4/1997 |

(Continued)

OTHER PUBLICATIONS

International Search Report issued Oct. 30, 2006 in the International (PCT) Application of which the present application is the U.S. National Stage.

(Continued)

*Primary Examiner* — James O Hansen
*Assistant Examiner* — Matthew Ing
(74) *Attorney, Agent, or Firm* — Wenderoth, Lind & Ponack, L.L.P.

(57) ABSTRACT

Lockable pushing-out device (1) for a furniture part guided in a movable manner in or on a piece of furniture, in particular for a drawer or door, having a spring-loaded drive element (5) for moving the movable furniture part out of a closed end position into an open position, wherein the drive element (5), for the purpose of transmitting force to the movable furniture part, is arranged such that it can be displaced in a guide track (8), and wherein the guide track (8) has at least one portion (A, A') which is designed such that the furniture part can be moved by virtue of the spring-loaded drive element (5) interacting with the guide track (8).

27 Claims, 11 Drawing Sheets

FOREIGN PATENT DOCUMENTS

Figure 1A:
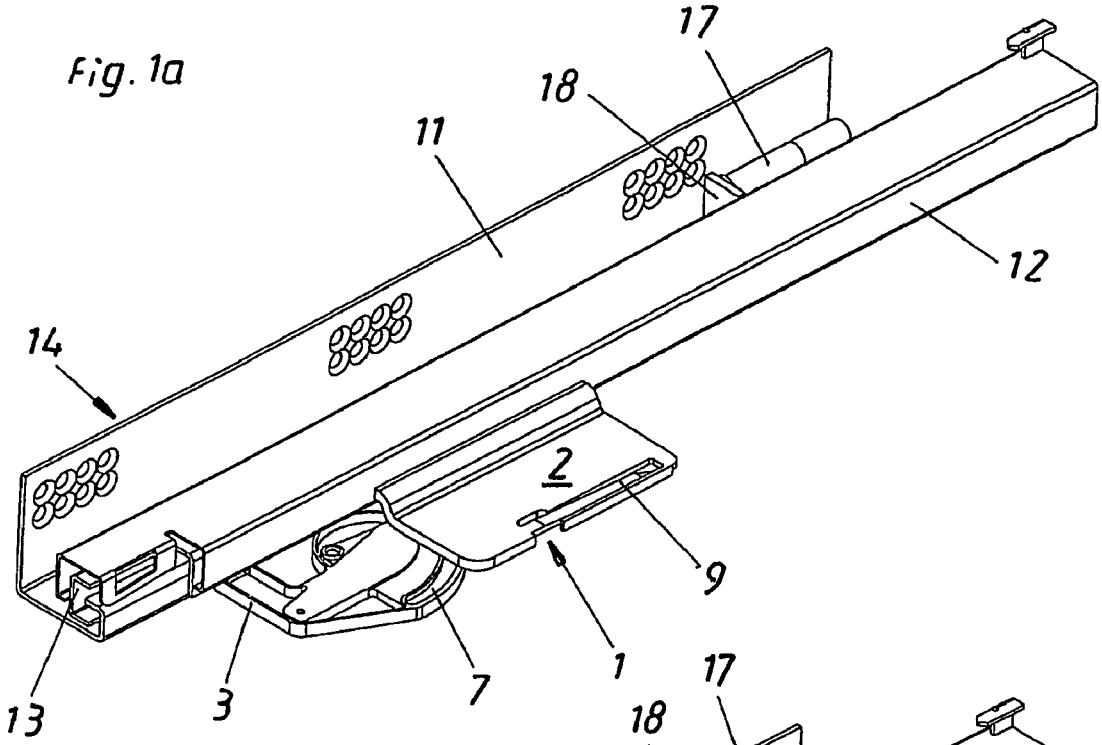

| | | |
|---|---|---|
| EP | 1 127 514 | 8/2001 |
| JP | 2-50275 | 11/1990 |
| JP | 5-7005 | 1/1993 |
| WO | 2004/101919 | 11/2004 |
| WO | 2005/012678 | 2/2005 |

OTHER PUBLICATIONS

Austrian Search Report issued Jan. 19, 2006 in the corresponding Austrian patent application.

English translation of Notification of Reasons of Refusal issued Sep. 12, 2011 in corresponding Japanese Application No. 2008-529408.

* cited by examiner

LOCKABLE PUSHING-OUT DEVICE

This application is a continuation of International application No. PCT/AT2006/000347, filed Aug. 23, 2006.

The invention relates to a lockable ejection device for a furniture part guided movable in or on an item of furniture, in particular a drawer or door, with a spring-loaded drive element to move the movable furniture part from a closed end position into an open position, wherein, to transmit force to the movable furniture part, the drive element is arranged displaceable in a guide track.

Lockable ejection devices for movable furniture parts are known in various embodiments. They are designed such that, in order to move the movable furniture part from a closed end position into an open position, the drive element acts, as a result of the relaxing of the spring, directly on the movable furniture part or is brought into engagement with a driving dog coupled with the movable furniture part.

Lockable ejection devices according to the preamble are as a rule formed such that the drive element is at the same time formed as a locking element to secure the movable furniture part in the closed end position. For this purpose the drive element is guided movable in a guide track which has a catch recess for arresting the drive element acted on by the spring under tension in the closed end position of the movable furniture part.

To eject the movable furniture part, according to the known touch latch principle the movable furniture part is first brought into a release position lying behind the closed end position in closing direction of the movable furniture part, wherein the drive or locking element is displaced in the guide track via a driving dog until it has left the catch recess and is located in a drive section running in the direction of action of the spring, i.e., the arrest of the movable furniture parts is removed. Because of the relaxing of the spring the drive element is then moved in the direction of opening of the movable furniture part and ejects the movable furniture part via the driving dog.

The lockable ejection devices known from the state of the art require not only large space but also precise adjustment of the position of the driving dog relative to the guide track, in order to ensure a simple closing and opening of the movable furniture part.

It is therefore an object of the invention to produce a lockable ejection device of the type mentioned at the outset which allows in a simple manner the tensioning and relaxing of the spring, and the arrest of the drive element when the spring is under tension and which in addition has a simple design.

According to the invention this object is achieved by the guide track having at least one section which is formed such that the furniture part is movable due to the cooperation of the spring-loaded drive element with the guide track. For this purpose according to a preferred embodiment example of the invention at least one section is arranged angular to the direction of movement of the movable furniture part.

In other words, the at least one angular section serves as a stop for the drive element and as an abutment for the spring during its tensioning and/or relaxing respectively, wherein the drive element is pulled, due to the spring force, against a side wall of the section of the guide track forming the stop and slides, because the guide track runs angular in this section, along said track.

According to a preferred embodiment of the ejection device according to the invention the guide track has several sections running angular to the direction of movement of the movable furniture part, of which a first section is formed as a stop for the drive element during tensioning of the spring and a second section is formed as a stop for the drive element during relaxing of the spring.

In this manner it is achieved that, in the case of an ejection device with a drive element acted upon by a force storage device, for example a spring or a fluid pressure storage device, which is guided movable in a guide track, there is no need for a separate driving dog coupled with the movable furniture part for charging and/or discharging of the force storage device, as the abutment is formed by an angular section of the guide track during charging and/or discharging of the force storage device according to the invention.

In order to ensure that the spring is also tensioned when the speed of movement of the movable furniture part is low, a further embodiment of the invention provides that, to tension the spring, the first section forms an angle between 30° and 80°, preferably between 60° and 65° to the direction of movement of the movable furniture part, while the second section advantageously forms an angle of approximately 90° to the direction of movement of the movable furniture part.

The securing of the movable furniture part in its closed end position after the tensioning of the spring takes place according to a further embodiment of the invention by the guide track having a locking section with a catch recess for the releasable arrest of the drive element when the movable furniture part is in closed end position.

In this case the guide section can run substantially parallel or normal relative to the direction of movement of the movable furniture part, only the catch recess must be arranged such that it arrests the drive element in the direction of opening of the movable furniture part.

A structurally particularly simple solution results according to a further embodiment example of the invention if the guide track is formed as a guide groove. In order to be able to keep the dimensions of the ejection device, in particular its length, small, a preferred embodiment example of the invention provides that the ejection device has two parts preferably linearly movable towards each other, wherein the spring-loaded drive element is housed rotatable in the first part and engages in a preferably groove-shaped guide track formed in the second part, wherein it has proved favorable if the guide track has an exit/entrance for the entry/exit of the drive element in the plane of the guide track.

In order to ensure that, upon relaxation of the spring, the movable furniture part is moved so far out of the item of furniture via the drive element that the whole of the front panel, which generally offers no grip, protrudes from the furniture carcass, a further embodiment of the invention provides that the drive element is housed rotatable by an angle greater than 45°, preferably 90°, relative to the direction of movement of the movable furniture part, in the first part of the ejection device.

If the drive element is formed as a lever to which a peg formed to engage in the guide track of the second part of the ejection device is preferably rotatably attached, a secure and stable guiding of the drive element in the guide track is guaranteed. An additional stabilizing of the ejection device can result, according to a preferred embodiment example of the invention in that the drive element is additionally guided via the peg in a guide track formed in the first part of the ejection device.

An alternative embodiment example of a lockable ejection device according to the invention for a furniture part guided movable manner in or on an item of furniture, in particular a drawer or door, with two parts preferably movable linearly towards each other, of which one part is allocated to the item of furniture and one part to the movable furniture part, and a spring-loaded drive element to move the movable furniture part out of a closed end position into an open position, provides that the ejection device has a coupling element acting between the two parts of the ejection device at least along one section of the opening/closing path of the movable furniture part, wherein each of the two parts of the ejection device has a guide track for the coupling element.

By forming two guide tracks for the coupling element joining the two parts of the ejection device, a particularly robust solution is achieved which moreover makes possible a precise guiding of the drive element in the guide position.

If the coupling element, as a further embodiment example of the invention provides, is housed rotatable by an angle greater than 45°, preferably 90°, in one part of the ejection device, and the guide track formed in the other part has an entrance/exit for the entry/exit of the drive element in the plane of the guide track, the coupling element is guided stable along the whole path between its two end positions, wherein a preferred embodiment example of the invention provides that a flexible tongue is arranged in the guide track directly before the exit such that it pushes the drive element onto an angular section of the guide track upon entry into the guide track, wherein an embodiment example of the invention with a particularly simple design provides that the coupling element is formed by the ejection element.

Furthermore an item of furniture with an ejection device according to the invention is to be provided in which neither parts of the ejection device nor separate driving dogs for the engagement with parts of the ejection device are attached to the movable furniture part, which is achieved according to the invention when the lockable ejection device has two parts, preferably movable linearly towards each other, and is integrated in the guide system, wherein a solution with a simple design provides that the guide system has at least one carcass rail attached stationary to the furniture carcass and one drawer rail movable along the carcass rail, wherein one part of the ejection device is securely connected to the carcass rail and the other part of the ejection device is attached stationary to the drawer rail.

In other words, the invention provides an ejection device for a furniture part guided movable in or on an item of furniture, which is integrated in the guide system and in which the attachment of additional separate driving dogs for parts of the ejection device to the movable furniture part or to parts of the guide system can be dispensed with.

To ensure that the movable furniture part is moved reliably into its closed end position even when the speed of travel is low, the attachment of a pull-in device preferably coupled or couplable with the drawer rail is provided according to a further embodiment example of the invention.

On the other hand, the release of the ejection device by too high a speed of travel of the movable furniture part upon closure of same can be prevented if the item of furniture comprises a damping device preferably coupled or couplable with the drawer rail.

Figure 1B:
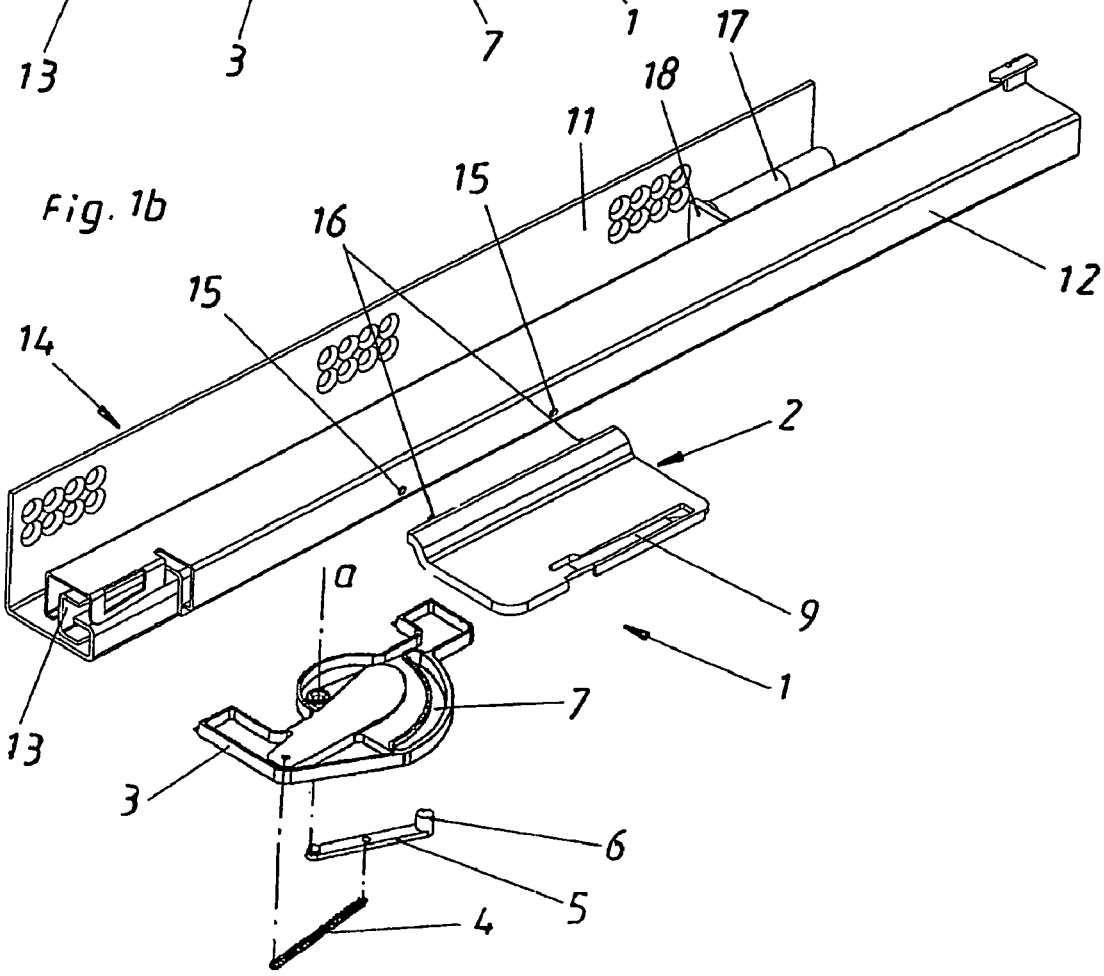
Figure 2B:
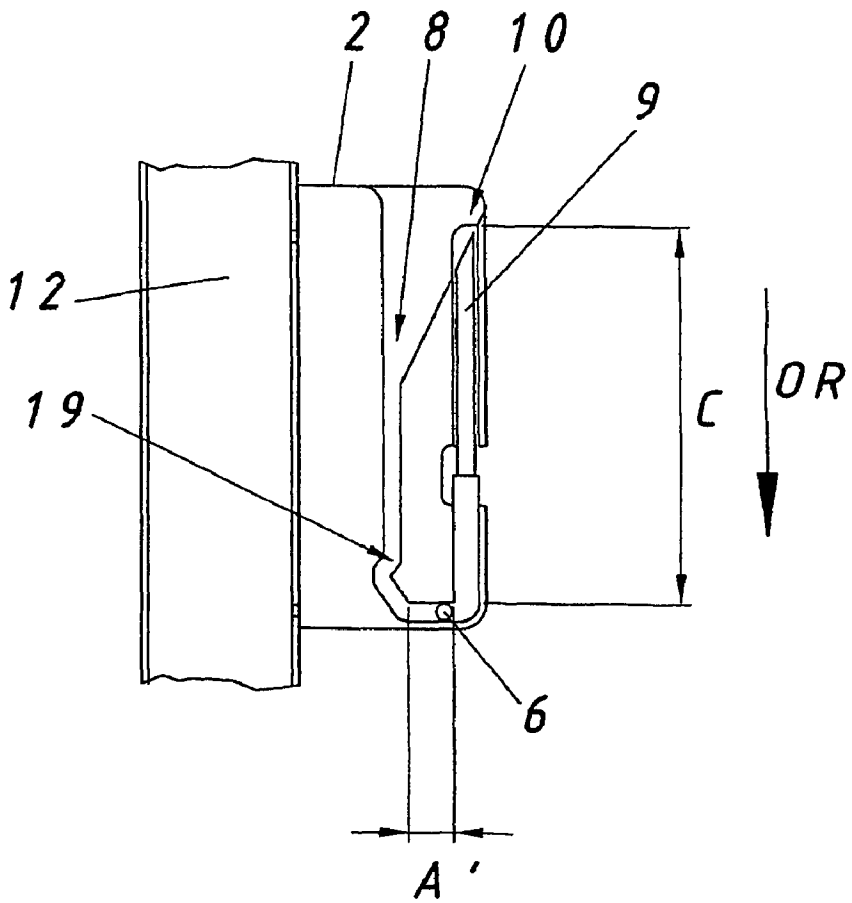
Figure 2A:
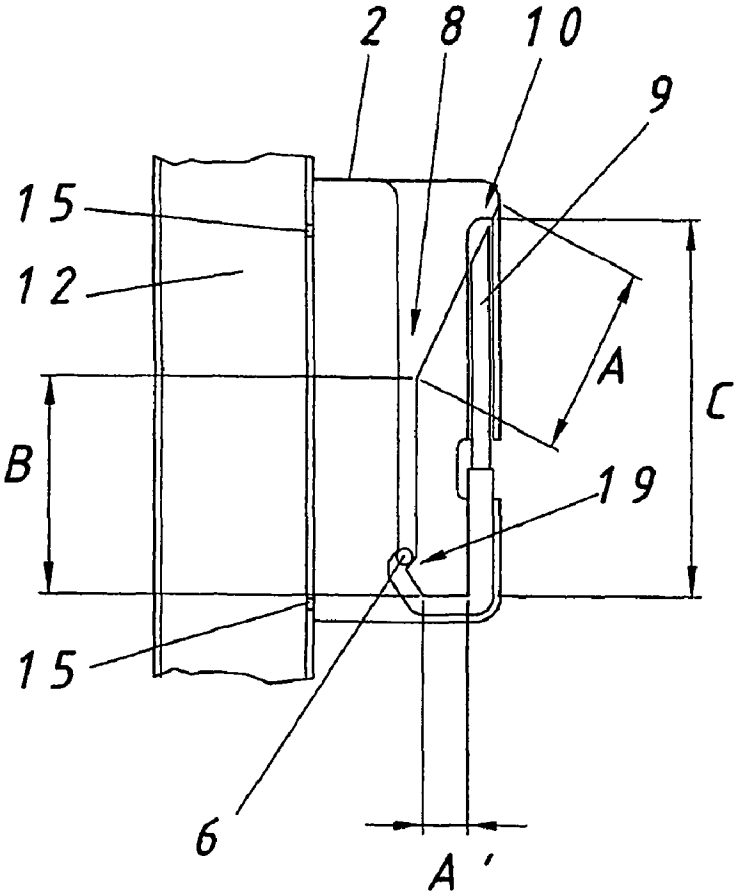
Figure 2D:
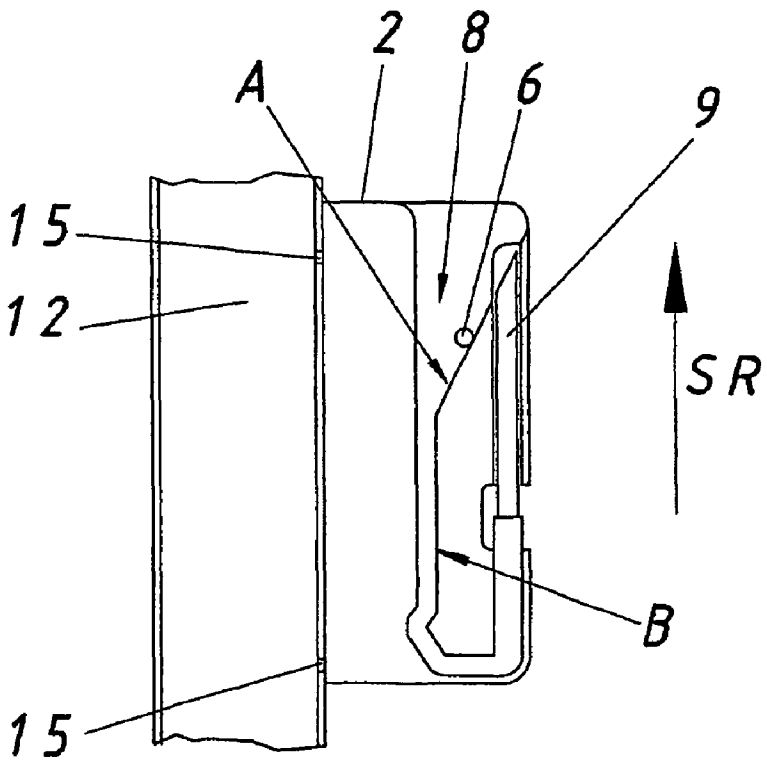
Figure 2C:
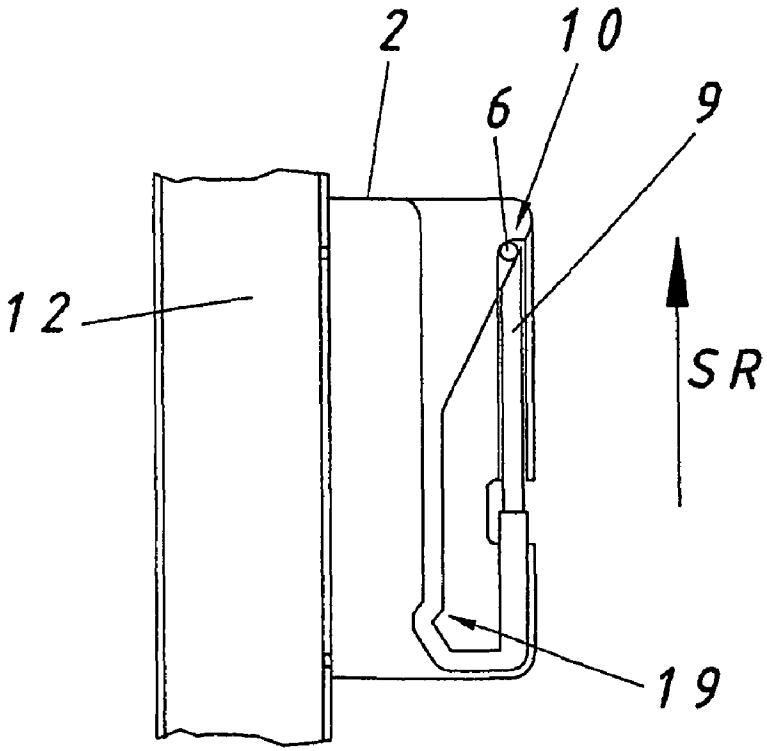
Figure 3A:
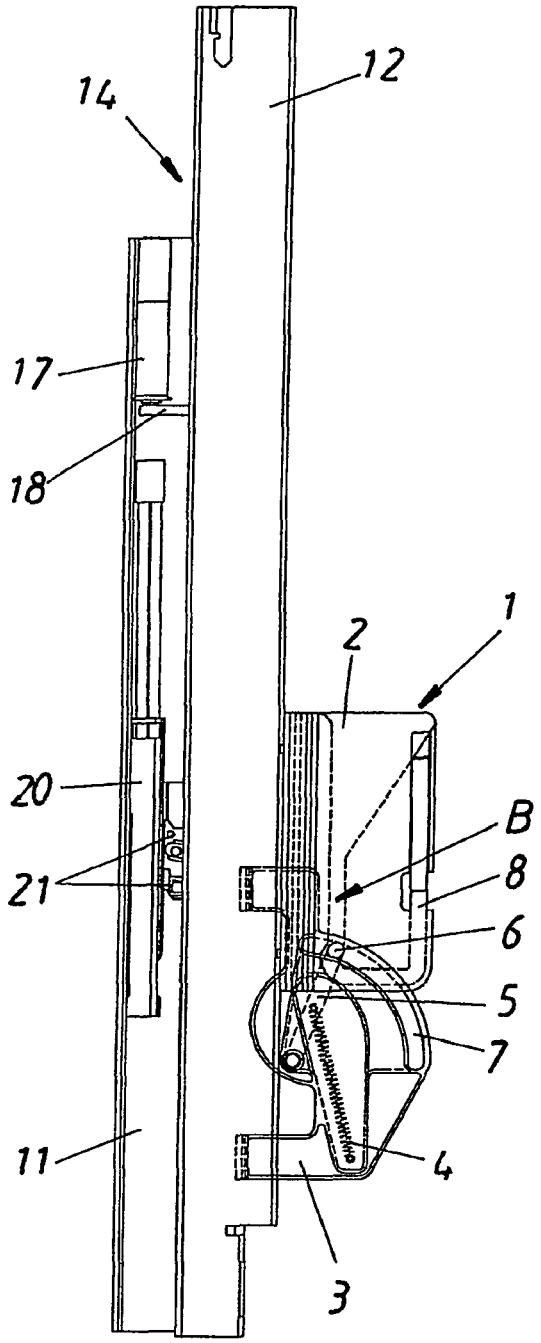
Figure 3B:
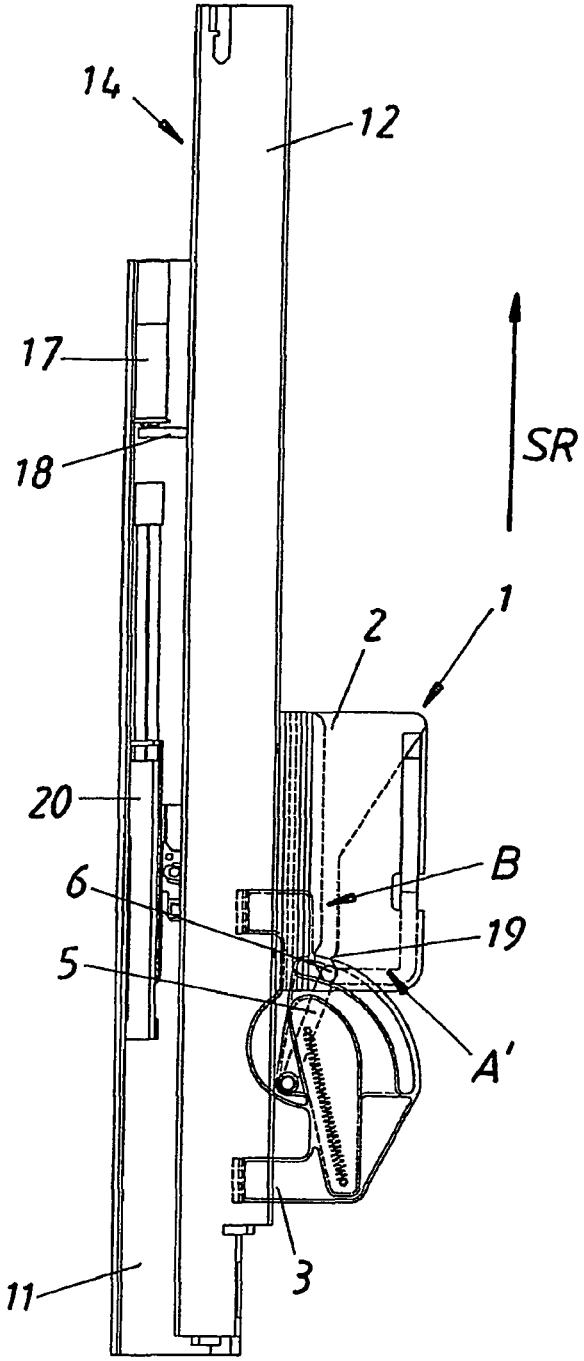
Figure 3C:
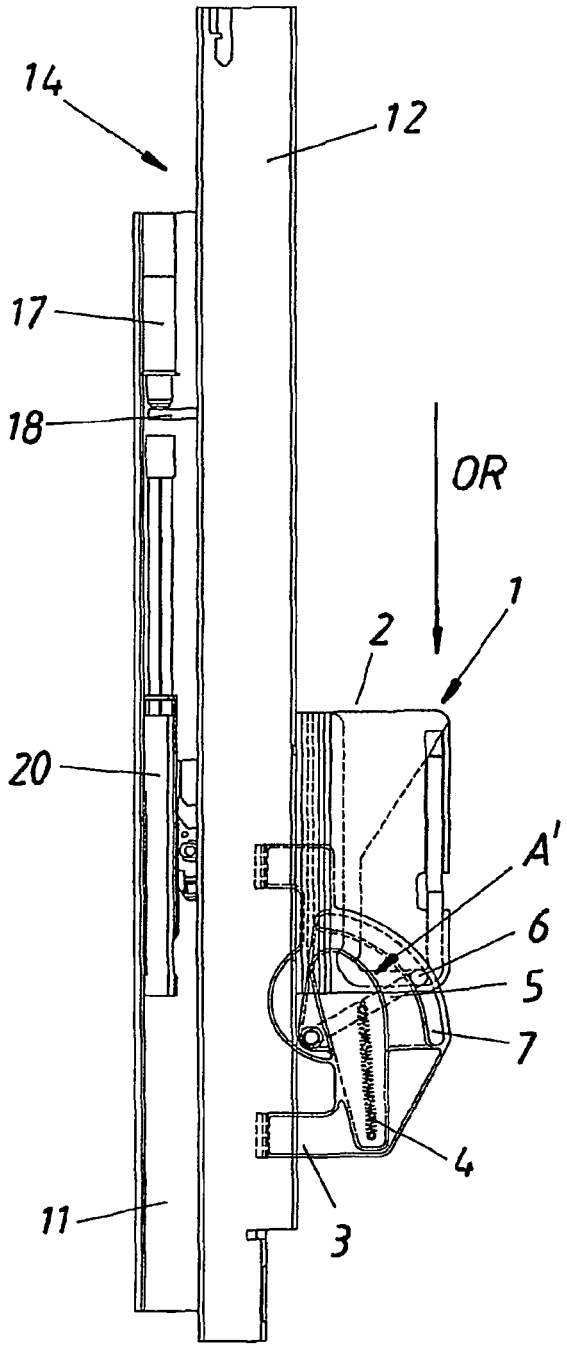
Figure 3D:
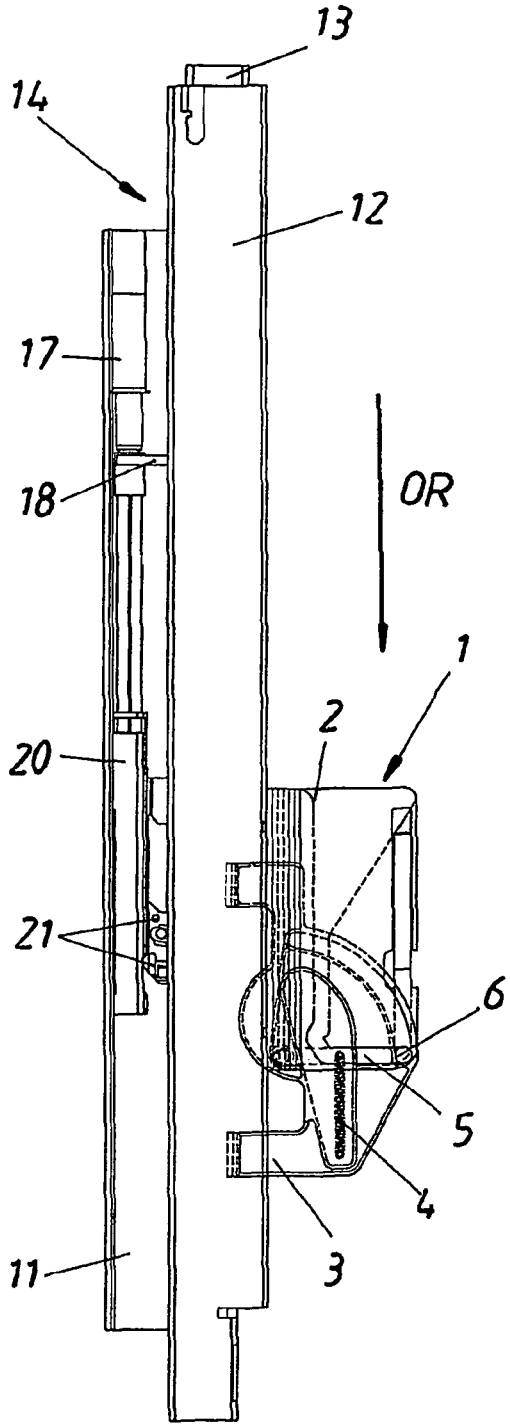
Figure 3E:
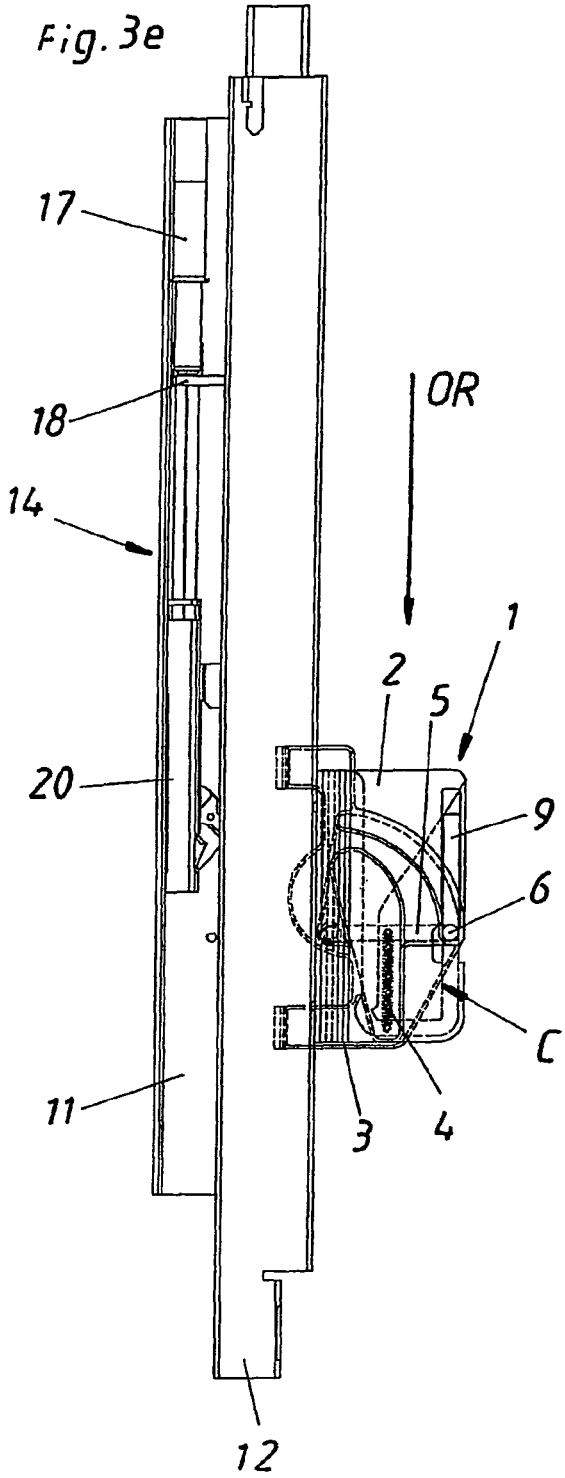
Figure 3F:
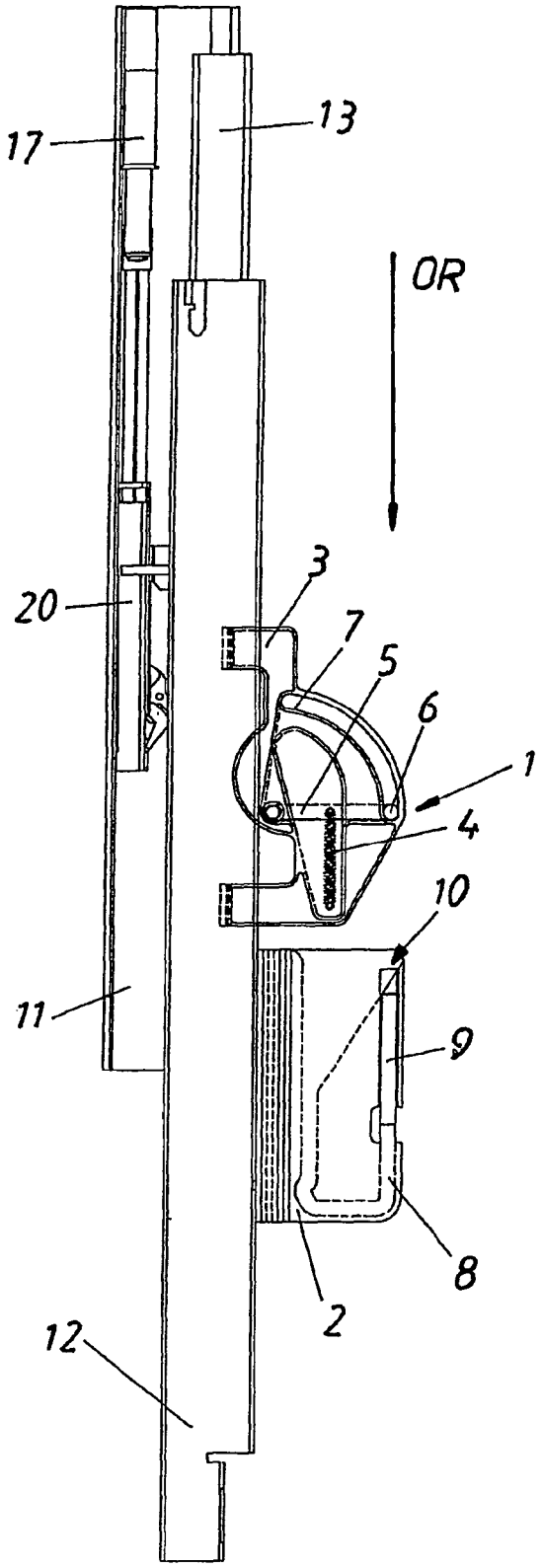
Figure 3G:
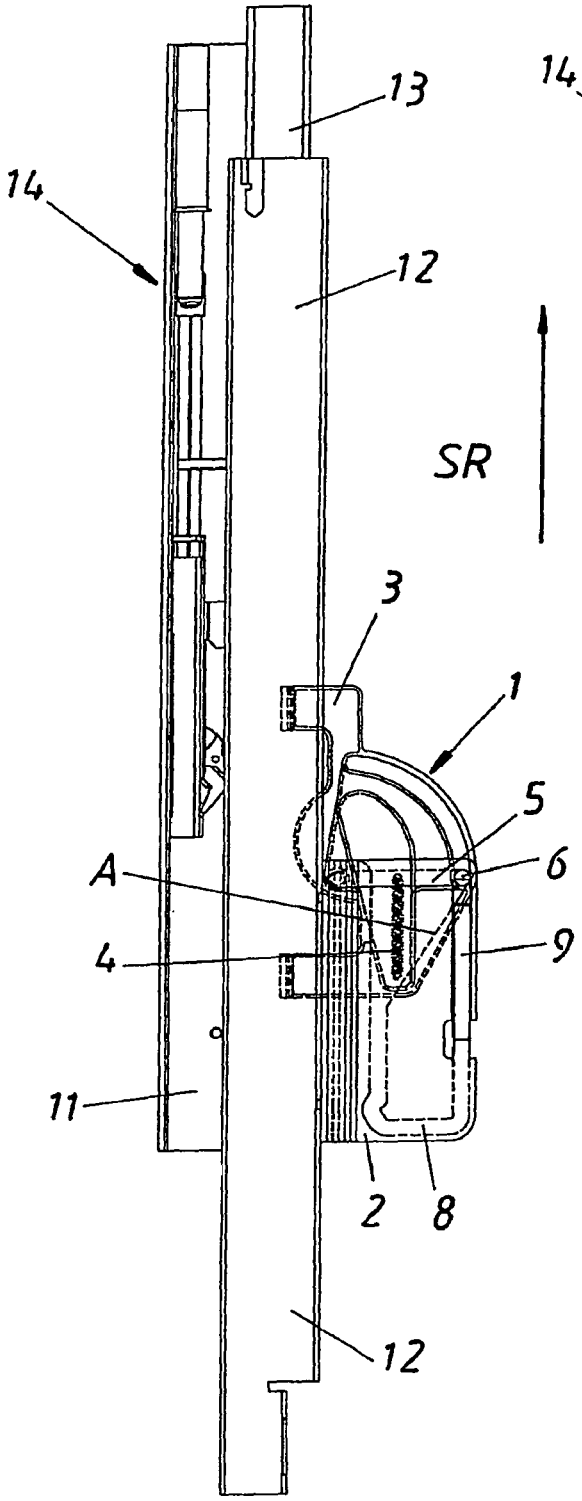
Figure 3H:
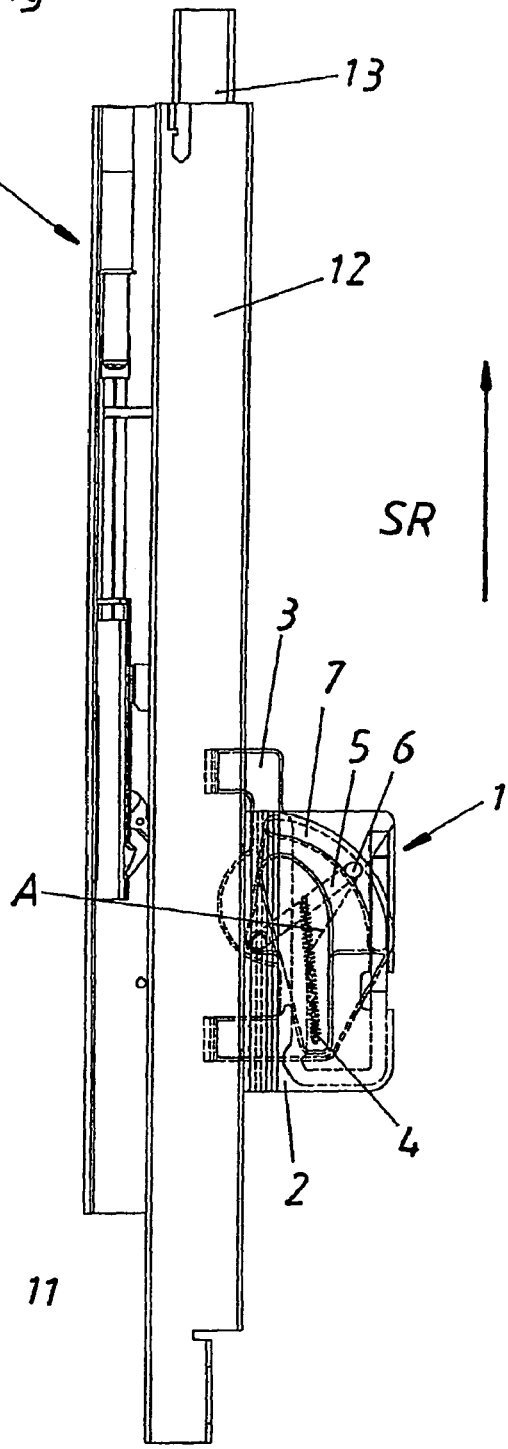
Figure 3I:
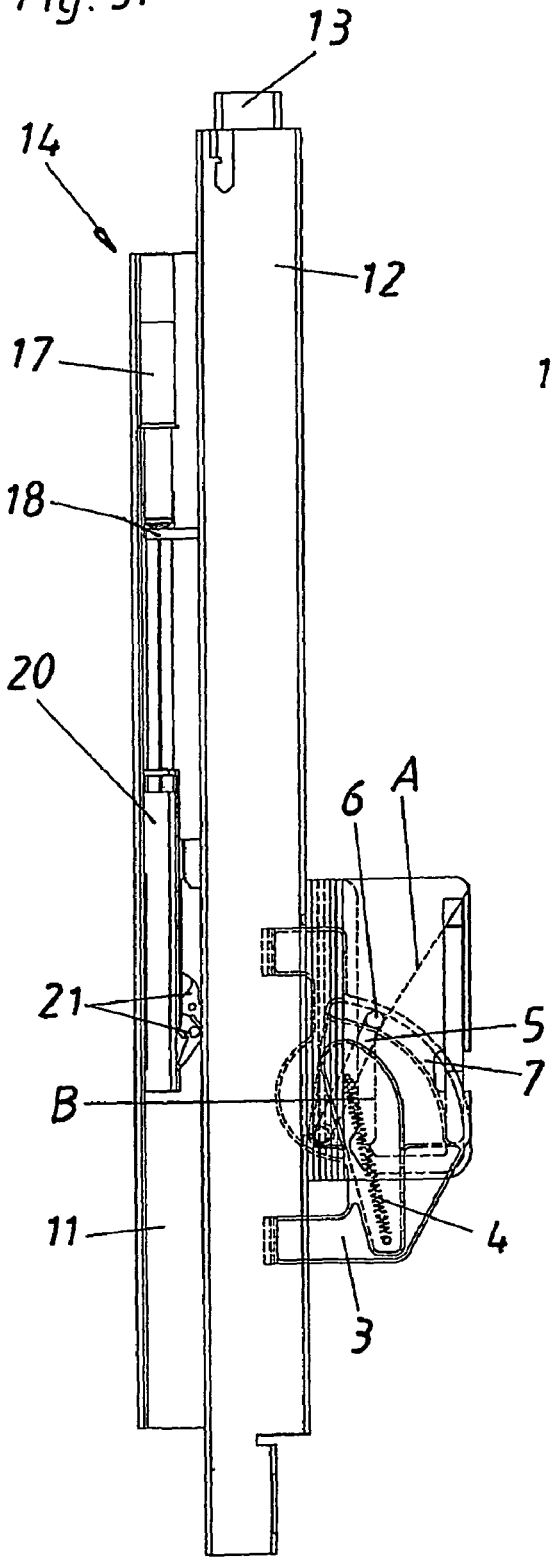
Figure 3J:
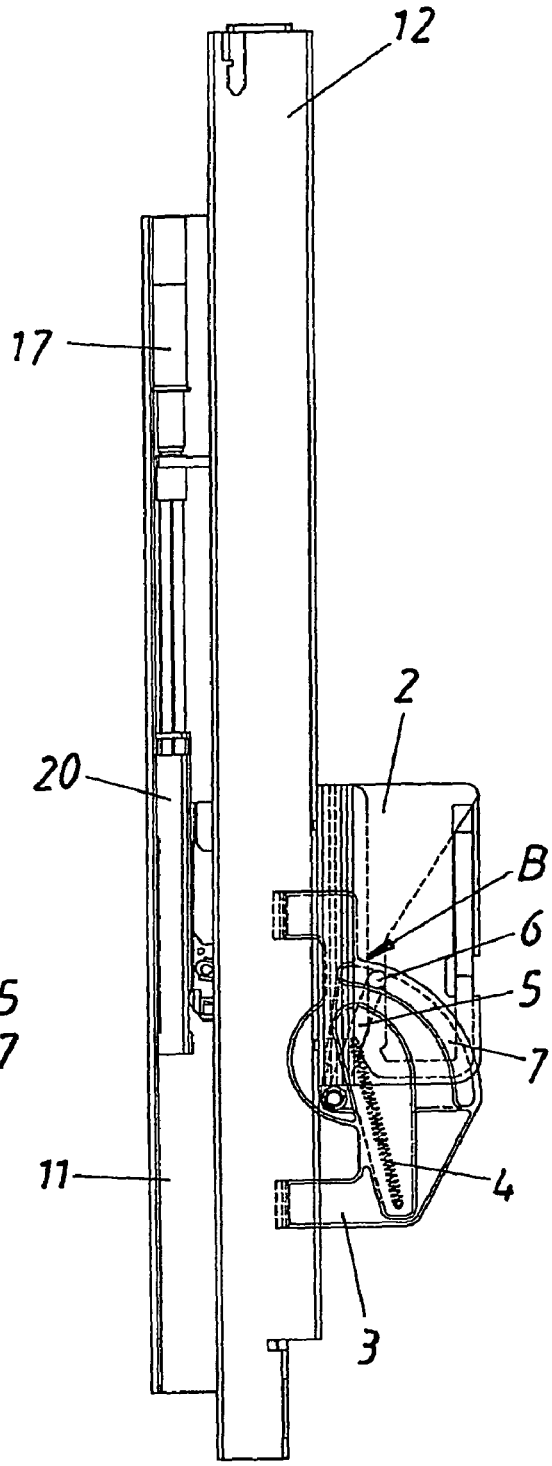
Figure 4:
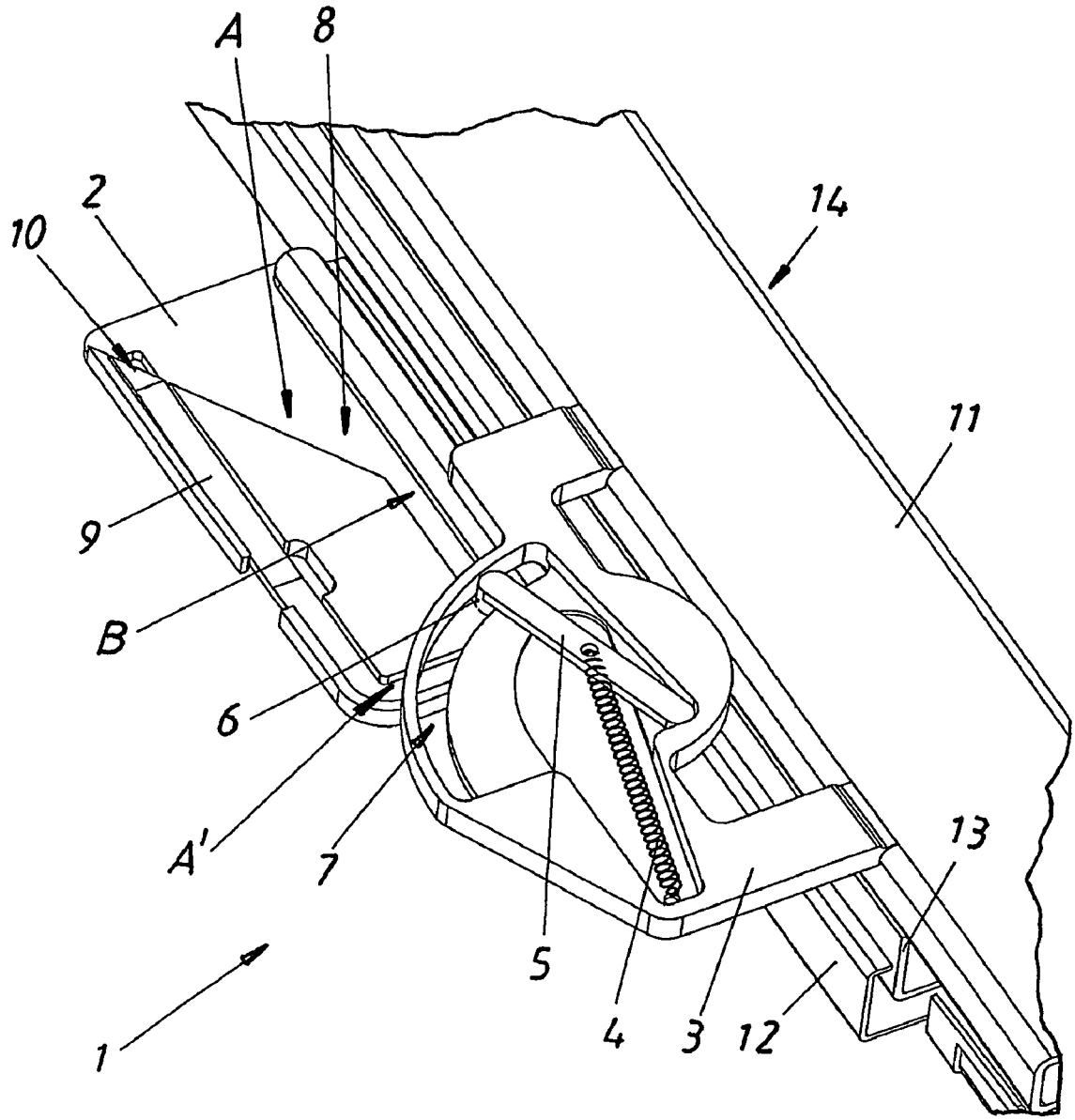
Figure 5A:
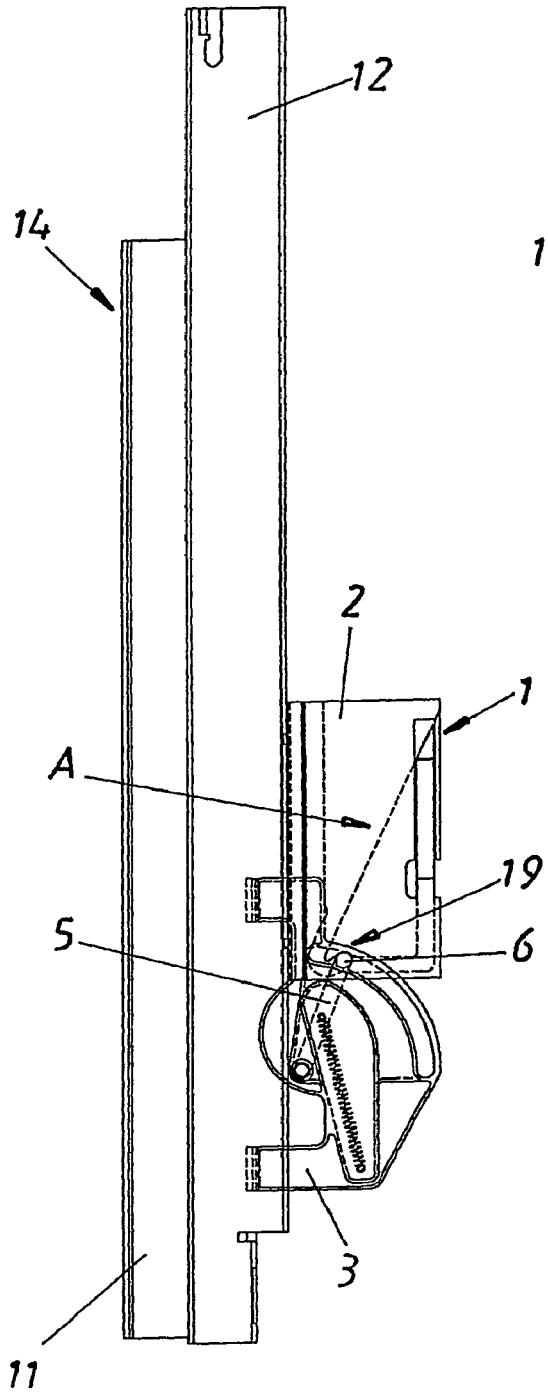
Figure 5B:
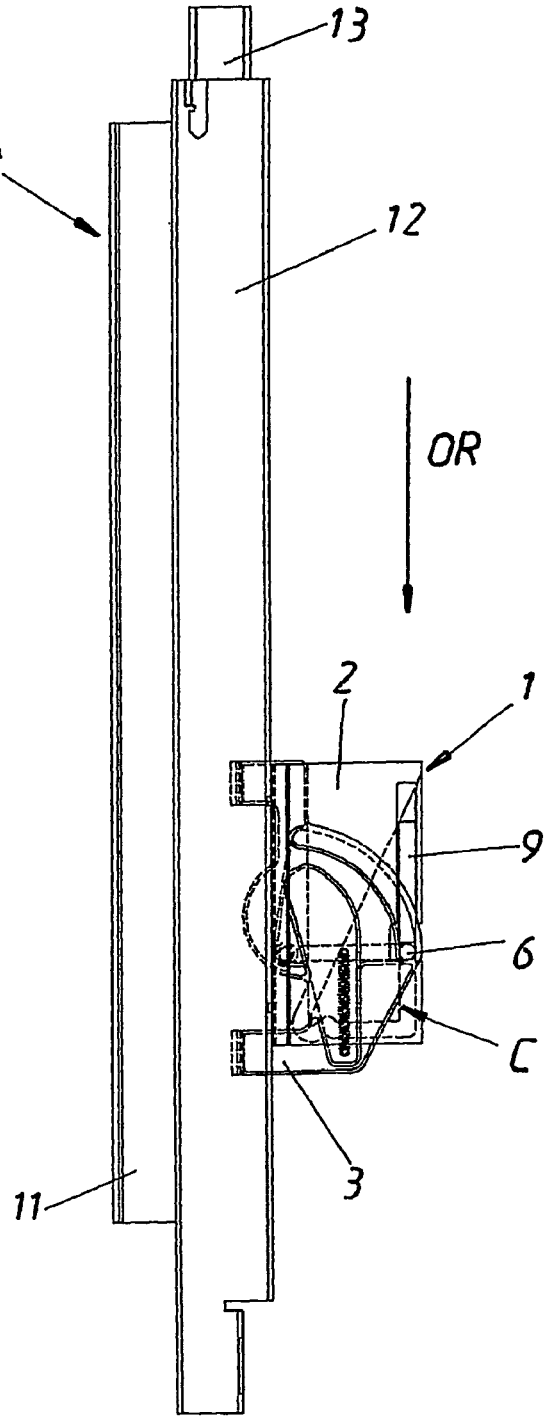
Figure 5C:
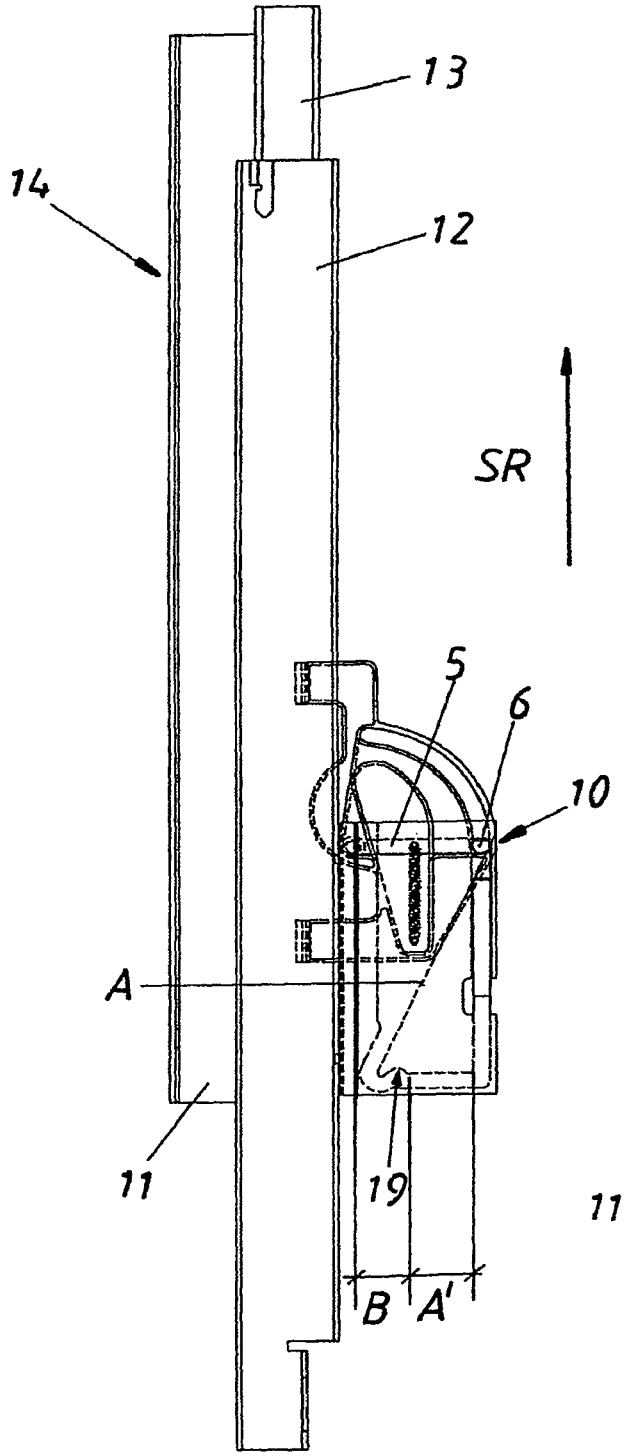
Figure 5D:
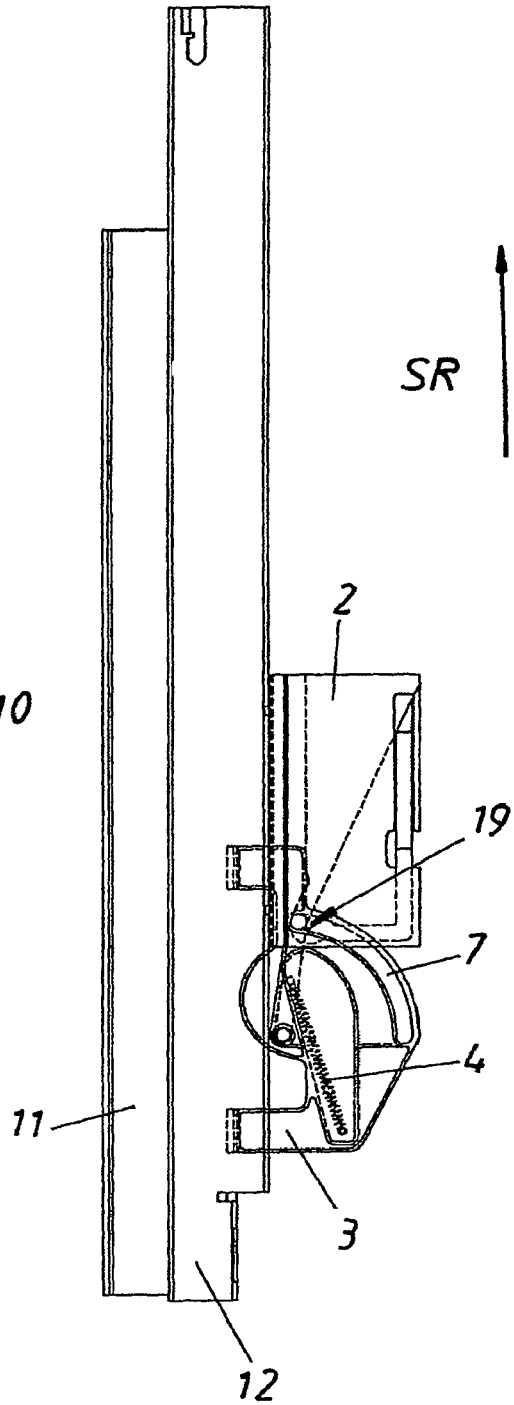

Further details and advantages of the lockable ejection device according to the invention are described in more detail in the following description of the figures with reference to the embodiment examples shown in the drawing. There are shown in:

FIG. 1*a* a first embodiment example of an ejection device integrated in a guide system, FIG. 1*b* the embodiment example according to FIG. 1*a* with an exploded view of the ejection device, FIGS. 2*a*-2*d* schematically different positions of the drive element in the guide track during an opening and closing movement of the movable furniture part, FIGS. 3*a*-3*j* the operating principle of a first embodiment example of an ejection device according to the invention during an opening and closing movement of a movable furniture part, FIG. 4 a perspective view from below of the ejection device from FIG. 3 and FIGS. 5*a*-5*d* the operating principle of a further embodiment example of an ejection device according to the invention during an opening and closing process of a movable furniture part.

FIG. 1*a* shows a first embodiment example of an ejection device 1 according to the invention which is integrated in a guide system 14 formed for fitting to an item of furniture, not shown. The guide system 14 is formed as a drawer pull-out guide and has a carcass rail 11 which can be attached stationary to the furniture carcass and a drawer rail 12, housed displaceable vis-à-vis the carcass rail 11 with an intermediate middle rail 13, which can be releasably connected to the movable item of furniture.

In the shown embodiment example, the ejection device 1 is formed in two parts and has two parts 2, 3 movable linearly towards each other, wherein the first part 3 is attached stationary to the carcass rail 11, while the second part 2 is attached stationary to the drawer rail 12.

FIG. 1*b* shows the embodiment example from FIG. 1*a* with an exploded view of the ejection device 1. In the first part 3 the drive element 5 is housed rotatable about an axis A substantially normal relative to the plane of the first part 3. The drive element 5 is formed as a lever which has a peg 6 on its end lying opposite the centre of rotation. The drive element 5 is acted on by a spring 4 secured in the first part 3 of the ejection device 1 and is guided via the peg 6 in the guide track 7 of the first part 3, wherein the peg 6 passes through the slit-shaped guide track 7 and engages with its free end in the guide track 8 formed in the second part 2 and this is guided movable (FIG. 4).

In addition to the guide track 8, a flexible tongue 9 is formed in the second part 2 of the ejection device 1, in the area of the entrance/exit 10 of the guide track 8.

In FIGS. 2*a* to 2*d* the second part 2 of the ejection device 1 is shown in a view from below, wherein the second part 2 is secured to the drawer rail 12 via connection means 16 in housing openings 15 of the drawer rail 12. Furthermore, in FIGS. 2*a* to 2*d* the peg 6 of the drive element 5 is schematically shown in different positions of the movable furniture part and thus of the ejection device 1.

In FIG. 2*a*, the peg 6 of the drive element 5 is in the locking section B of the guide track 8, in the catch recess 19, i.e., the movable furniture part is in its closed end position. In order to start the ejection procedure, the movable furniture part is firstly moved by the user into a release position located behind the closed end position in closing direction SR, with the result that the peg 6 is displaced in the guide track 8 and leaves the catch recess 19, whereby the locking of the spring-loaded drive element 5 is removed.

In FIG. 2*b*, the peg 6 of the drive element 5 is already in the angular section A' of the guide track 8, which can also be called drive section. Due to the relaxing spring 4, the drive element 5 is pivoted laterally and, by sliding along the side wall of the angular section A' of the guide track 8, entrains the second part 2 of the ejection device 1 in the opening direction OR of the movable furniture part, whereby the movable furniture part is moved from its closed end position shown in FIG. 2*a* into an open position.

Joined to the first angular section A' of the guide track 8 is a section C substantially parallel to the direction of movement SR, OR of the movable furniture part, which has at its end lying opposite the angular section A' an entrance/exit 10 for the peg 6 of the drive element 5.

If the peg 6 of the drive element 5 has passed the angular section A' of the guide track 8, the ejection procedure has ended and the movable furniture part can be moved manually by the user into its opened end position, wherein the peg 6 of the drive element 5 is displaced in section C of the guide track 8 (FIG. 2*c*).

Upon closure of the movable furniture part, the peg 6 is pushed by the flexible tongue 9, which closes the entrance 10 formed in the end-area of section C, onto the first angular section A of the guide track 8. For this purpose, the flexible tongue 9 is formed wedge-shaped at its free end. As the movable furniture part moves further into the furniture carcass (FIG. 2*d*), the peg 6 slides along the walls of the angular section A, whereby the spring 4 of the ejection device 1 is tensioned. Naturally, a different force storage device, for example a fluid pressure storage device, could also be used instead of the spring 4.

If the peg 6 has passed the angular section A of the guide track 8, the spring 4 is tensioned or the force storage device charged. The peg 6 then passes through the locking section B of the guide track 8 until it engages in the catch recess 19, whereby the spring-loaded drive element 5 is locked.

In the shown embodiment example, the guide system 14, as will be explained in more detail later, is provided with a damped automatic pull-in system. For this reason, the locking section B has in front of the catch recess 19 a section substantially parallel to the direction of movement OR, SR of the movable furniture part, in which, after the tensioning of the spring 4 at the end of the angular section A, the movable furniture part is moved into its closed end position, when the spring 4 is tensioned, by means of the damped pull-in device. The effect of such a design is on the one hand that the movable furniture part is moved into its closed end position even if the user only slightly accelerates the movable furniture part, while on the other hand, in the case of too great an acceleration of the movable furniture part by the user, the movable furniture part is prevented from striking the furniture carcass, and the ejection device prevented from being immediately released, by means of the damped pull-in device.

In FIGS. 3*a* to 3*j*, different positions of the ejection device 1 integrated in the guide system 14 during an opening and closing procedure of a movable furniture part (not shown) are shown. The ejection device 1 corresponds to the embodiment example shown in FIGS. 1*a* and 1*b*.

In FIG. 3*a*, the movable furniture part is in its closed end position, i.e., the peg 6 of the drive element 5 acted on by the spring 4 is located in the catch recess 19 of the locking section B of the guide track 8, with the result that the ejection device 1 is locked. The spring-loaded drive element 5 is housed rotatable in a first part 3 of the ejection device 1 and guided pivotable in a guide track 7 of the first part 3. The peg 6, which passes from below through the guide track 7, engages with its free end in the guide track 8 of the second part 2 of the ejection device 1, wherein the first part 3 of the ejection device 1 is fixedly connected to the carcass rail 11 of the guide systems 14 and the second part 2 of the ejection device 1 connected stationary to the drawer rail 12 of the guide system 14.

Also attached to the carcass rail 11 is a pull-in device 20 which can be brought into engagement via coupling elements 21 with the drawer rail 12 which can be moved relative to the coupling rail 11. Also attached to the carcass rail 11 is a damping device 17 in the form of a fluid pressure absorber which cooperates with a stop 18 attached to the drawer rail 12.

To open the movable furniture part or to release the locking of the drive element 5, in a first step (FIG. 3*b*) the movable furniture part is moved by the user into a release position located behind the closed end position in closing direction SR. With the movable furniture part, the drawer rail 12 and the second part 2, connected to the drawer rail 12, of the ejection device 1, is also moved in closing direction SR, whereby the drive element 5 housed rotatable in the first part 3 leaves the catch recess 19 of the locking section B of the guide track 8, with the result that the locking of the drive element 5 is removed and the ejection procedure begins.

Due to the relaxing spring 4, the drive element 5, guided in the guide track 7 of the first part 3 of the ejection device 1, is pivoted to the right (FIG. 3*c*) and slides along a wall of the angular section A' of the guide track 8, which can also be called drive section, whereby the second part 2 of the ejection device 1, and with it the drawer rail 12, is moved in the direction of opening OR of the movable furniture part. The stop 18 attached to the drawer rail 12 likewise moves in the opening direction OR, whereby the damping device 17 relaxes.

In FIG. 3*d*, the drive element 5 is located at the end of the angular section A' and the spring 4 is completely relaxed, i.e. the ejection procedure has ended and the movable furniture part is located in an open position. The relaxation procedure of the damping device 17 is continued further by the drawer rail 12 moving in the opening direction OR. The drawer rail 12 is furthermore brought into engagement with the pull-in device 20 via the coupling elements 21 in order to charge the force storage device of same. It is not important whether the force storage device of the pull-in device 20 is formed by a spring or by a fluid pressure storage device.

If the drawer rail 12 is moved further in the opening direction OR via the movable furniture part (FIG. 3*e*), the section C of the guide track 8 parallel to the direction of movement OR, SR travels outwards, guided via the peg 6 of the drive element 5, until the peg 6 leaves the guide track 8. The flexible tongue 9, arranged directly in front of or in the area of the exit 10 of the guide track 8 and protruding into same from above, is pressed upwards by the peg 6 until the drive element 5 has left the guide track 8 (3*f*). At this point, the pull-in device 20 is fully charged and the damping device 17 discharged.

If the movable furniture part is closed again by the user after reaching the open position, the drawer rail 12 moves, and with it the second part 2 of the ejection device 1 in the closing direction SR of the movable furniture part (FIG. 3*g*). As the drive element 5 arranged in the first part 3 of the ejection device 1 is crossed, the wedge-shaped flexible tongue 9 protruding into the entrance/exit 10 of the guide track 8 arranged in the second part 2 of the ejection device 1 moves the peg 6 of the drive element 5 onto the angular section A of the guide track 8 (FIG. 3*h*).

Due to the angular section A of the guide track 8, the drive element 5, guided in the guide track 7 of the first part 3 of the ejection device, is pivoted to the left with the result that, because of the interplay of the peg 6 with the angular section A of the guide track 8, the spring 4 acting on the drive element 5 is tensioned.

In the position shown in FIG. 3*i* the tensioning of the spring 4 has ended and the peg 6 of the drive element is located at the end of the angular section A. At the same time, the pull-in device 20 is brought into engagement with the drawer rail 12 via the coupling elements 21, with the result that the drawer rail 12, and with it the movable furniture part, is moved by means of the pull-in device 20 into its closed end position, wherein the closing movement is damped by means of the damping device 17. During this pull-in procedure, the peg 6 of the drive element 5 travels along a section of the locking section B of the guide track 8 substantially parallel to the direction of movement OR, SR of the movable furniture part until it is located in the catch recess 19, whereby the drive element 5 is locked again.

Another embodiment example of an ejection device 1 according to the invention is shown in FIGS. 5*a* to 5*d*. Unlike the first embodiment example, the guide system 14 of the embodiment example shown in FIGS. 5*a* to 5*d* has no pull-in and damping device. The absence of a pull-in device means that the angular section A of the guide track 8 extends right up to the catch recess 19 of the locking section B of the guide track 8. Contrary to the previously described embodiment example, in this embodiment example the locking section B runs substantially in the same direction as the angular section A' of the guide track, which can also be called drive section.

In other respects, this embodiment example operates according to the same operating principle as the embodiment example according to FIGS. 1 to 4, for which reason a further description is dispensed with.

The described embodiment examples of lockable ejection devices for furniture parts guided movable in or on an item of furniture are naturally not to be understood as limitative, but only as individual examples of numerous possibilities for realizing the concept of the invention of a lockable ejection device.

The invention claimed is:

1. A lockable ejection device for use with a moveable furniture part in an item of furniture, the lockable ejection device comprising:

a spring-loaded drive element, including a spring and a peg, for transmitting force to the movable furniture part and moving the movable furniture part out of a closed position and into an open position; and a guide track having a drive section and a locking section, wherein said spring-loaded drive element is arranged displaceably and guided by said peg in said guide track, and the furniture part is both (i) movable by said peg of said spring-loaded drive element interacting with said drive section of said guide track, and (ii) lockable by said peg of said spring-loaded drive element interacting with said locking section of said guide track.

2. The lockable ejection device according to claim 1, wherein the drive section is formed in a direction angular to a direction of movement of the furniture part.

3. The lockable ejection device according to claim 2, wherein, in order to tension the spring, the tensioning section forms an angle between 30° and 80° to the direction of movement of the movable furniture part.

4. The lockable ejection device according to claim 2, wherein, in order to tension the spring, the tensioning section forms an angle between 60° and 65° to the direction of movement of the movable furniture part.

5. The lockable ejection device according to claim 2, wherein, in order to relax the spring, the drive section forms an angle of approximately 90° to the direction of movement of the movable furniture part.

6. The lockable ejection device according to claim 1, wherein the locking section runs substantially parallel to the direction of movement of the movable furniture part.

7. The lockable ejection device according to claim 1, wherein the locking section runs substantially normal relative to the direction of movement of the movable furniture part.

8. The lockable ejection device according to claim 1, wherein the guide track is formed as a guide groove.

9. The lockable ejection device according to claim 1, wherein the guide track has an entrance/exit for an entry/exit of the drive element in a plane of the guide track.

10. The lockable ejection device according to claim 1, wherein the lockable ejection device has a first part and a second part movable towards each other, and the spring-loaded drive element is housed rotatably in the first part and engages in the guide track formed in the second part.

11. The lockable ejection device according to claim 10, wherein the first part and second part of the ejection device are linearly movable towards each other.

12. The lockable ejection device according to claim 1, wherein the drive element is housed rotatably by an angle greater than 45° relative to the direction of movement of the movable furniture part, in a first part of the ejection device.

13. The lockable ejection device according to claim 12, wherein the drive element is housed rotatably by an angle of 90°.

14. The lockable ejection device according to claim 1, wherein the peg is rotatably attached to the drive element.

15. The lockable ejection device according to claim 1, comprising:

a first part to be attached to an item of furniture;

a second part to be attached to the movable furniture part so that the first and second parts are movable towards each other; and a coupling element acting between the first and second parts, at least along one section of the opening/closing path of the movable furniture part, such that each of the two parts of the ejection device has a guide track for the coupling element.

16. The lockable ejection device according to claim 15, wherein the coupling element is housed rotatably by an angle greater than 45° in one part of the ejection device, and the guide track formed in the other part has an entrance/exit for the entry/exit of the drive element in a plane of the guide track.

17. The lockable ejection device according to claim 15, wherein the coupling element is housed rotatably by an angle of 90°.

18. The lockable ejection device according to claim 15, wherein the coupling element is formed by the lockable ejection device.

19. An item of furniture with the lockable ejection device according to claim 1, wherein the lockable ejection device has a first part and a second part that are movable towards each other, and the lockable ejection device is integrated in a guide system for the movable furniture part.

20. The item of furniture with the lockable ejection device according to claim 19, wherein the two parts of the ejection device are linearly movable towards each other.

21. The item of furniture according to claim 19, wherein the guide system has at least one stationary carcass rail attached to the furniture carcass and one movable drawer rail along the carcass rail, and one part of the lockable ejection device is securely connected to the stationary carcass rail and the other part of the lockable ejection device is attached to the movable drawer rail.

22. The item of furniture according to claim 19, having a pull-in device.

23. The item of furniture according to claim 22, wherein the pull-in device is coupled or couplable with the movable drawer rail.

24. The item of furniture according to claim 19, having a damping device.

25. The item of furniture according to claim 24, wherein the damping device is coupled or couplable with the movable drawer rail.

26. A lockable ejection device for use with a movable furniture part in an item of furniture, the lockable ejection device comprising:

a first part including a spring-loaded drive element, arranged on the first part and including a peg, for transmitting force to the guide track in the second part and moving the movable furniture part out of a closed position and into an open position; and a second part including a guide track, arranged in the second part, having a drive section and a locking section, wherein said drive element is arranged displaceably and guided by said peg in said guide track, the furniture part is both (i) movable by said peg of said spring-loaded drive element interacting with said drive section of said guide track, and (ii) lockable by said peg of said spring-loaded drive element interacting with said locking section of said guide track, and the first and second part are moveable towards each other and the second part is allocated to the movable furniture part and the first part is allocated to the item of furniture.

27. A lockable ejection device for use with a movable furniture part in an item of furniture, the lockable ejection device comprising:

a first part including a first guide track, formed in said first part, a spring, and a drive element, including a peg, loaded by said spring for moving the movable furniture part out of a closed end position and into an open position; and a second part including a second guide track, formed in said second part and having at least a drive section and a locking section, the drive section formed in a direction angular to a direction of movement of the furniture part, wherein the first and second part are moveable towards each other and one of the first part or second part is allocated to the movable furniture part and the other one of the first or second part is allocated to the item of furniture, said drive element is displaceably guided via the peg in the guide track of said first part and said drive element is also displaceably guided via the peg in the guide track of said second part, and the furniture part is moved from a closed position to an open position due to tension in the spring-loaded drive element interacting with both, the first guide track and the at least one drive section of the second guide track.

* * * * *